US007004460B2

(12) United States Patent
Ruhe et al.

(10) Patent No.: US 7,004,460 B2
(45) Date of Patent: Feb. 28, 2006

(54) MEDIA BIAS ASSEMBLY FOR HARDCOPY DEVICES

(75) Inventors: Tom Ruhe, La Center, WA (US); Ray Sherman, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 273 days.

(21) Appl. No.: 10/423,368

(22) Filed: Apr. 23, 2003

(65) Prior Publication Data

US 2004/0212140 A1 Oct. 28, 2004

(51) Int. Cl.
*B65H 3/32* (2006.01)

(52) U.S. Cl. ..... 271/113; 271/109; 271/117

(58) Field of Classification Search ..... 271/113, 271/109, 117
See application file for complete search history.

(56) References Cited

U.S. PATENT DOCUMENTS 5,897,112 A * 4/1999 Kwag ..... 271/38
5,932,313 A * 8/1999 Barton ..... 428/141

FOREIGN PATENT DOCUMENTS

JP 60082541 A * 5/1985
JP 9 19999 * 1/1997

* cited by examiner

*Primary Examiner*—Donald R. Walsh
*Assistant Examiner*—Kaitlin Joerger

(57) ABSTRACT

The illustrated embodiment comprises a media bias assembly for use in a hardcopy device. A driven pick roll delivers media from a stack of media to a media feed path in the hardcopy device. Media is contained in an input tray and the pick roll is mounted on one side of the centerline through the tray. A passive media bias arm having a media contacting surface on one end is configured for making contact with media contained in the input tray and is spaced apart from the pick roll on the opposite side of the centerline.

24 Claims, 3 Drawing Sheets

MEDIA BIAS ASSEMBLY FOR HARDCOPY DEVICES

TECHNICAL FIELD

This invention relates to hardcopy devices, and more particularly to a media bias assembly for accurate control and delivery of media to the hardcopy device.

BACKGROUND OF THE INVENTION

Hard copy devices process images on media, typically taking the form of scanners, printers, plotters (employing inkjet or electron photography imaging technology), facsimile machines, laminating devices, and various combinations thereof, to name a few. These hardcopy devices typically transport media in a sheet form from a supply of cut sheets or a roll, to an interaction zone where scanning, printing, or post-print processing, such as laminating, overcoating or folding occurs. Often different types of media are supplied from different supply sources, such as those containing plain paper, letterhead, transparencies, pre-printed media, etc.

The relative position of the paper and the operative structures in the interaction zone is precisely maintained to effect high-quality media processing in the interaction zone. For example, in the case of an inkjet printer, printing occurs in the interaction zone and the position of an ink cartridge as it reciprocates in a back and forth motion across the media, and the positioning and control of paper as it advances past the printheads in the ink cartridge are controlled to produce high quality images. The media advancement through the hardcopy devices, and the positioning of the operators in the interaction zone are typically separately controlled, although their operation is coordinated with a hardcopy controller.

Hardcopy apparatus typically include media advancement mechanisms that serve to advance the recording media from one or more media sources through a media feed path and through the interaction zone. Again in the case of an inkjet printer, the interaction zone is typically a "printzone" where ink is applied to the paper. The media advance mechanisms move the paper through the interaction zone the desired distance, often in incremental steps, at the desired rate, and in a manner such that the media is oriented correctly relative to the devices found in the interaction zone. Achieving high quality media processing is often impeded by media feed errors such as overfeeding and underfeeding, and misalignment errors such as skewing.

Proper delivery of the media from the media supply, such as an input tray, and into the media feed path is an important first step in correctly feeding the media through the hardcopy device. In hardcopy devices that rely upon swing-arm media pick systems, recording media is held in a passive input tray. The swing-arm has a driven pick wheel that is biased onto the media and initiates movement of the media from the tray into a media feed path, which usually is curved, in the hardcopy device. To accommodate many different sizes of media, the swing-arm assembly is generally located to one side of the input tray. In operation, since swing-arm pick systems usually contact the media on one side of the sheet, the systems tend to constrain media curvature in some portions of the media, while other portions remain unconstrained. Said in another way, since the swing-arm mechanism contacts and drives the media from an off-center position, there are greater driving forces applied to some parts of the media than others. The result is often that the media twists or shifts such that the leading edge of the media arrives at the next media drive rollers at different times—a skewing error that can lead to printing errors such as poor margin control and crooked print, or media feed errors such as paper damage and jams.

SUMMARY

The illustrated embodiment comprises a media bias assembly for use in a hardcopy device. A driven pick roll delivers media from a stack of media to a media feed path in the hardcopy device. Media is contained in an input tray and the pick roll is mounted on one side of the centerline through the tray. A passive media bias arm having a media contacting surface on one end is configured for making contact with media contained in the input tray and is spaced apart from the pick roll on the opposite side of the centerline.

DETAILED DESCRIPTION OF PREFERRED EMBODIMENTS

In hardcopy devices such as printers, plotters (employing inkjet or electron photography imaging technology), facsimile machines, etc. it is important to maintain proper relative position between the print devices (such as inkjet cartridges) and the media to effect high-resolution, high-quality printing. One early step in the proper positioning of cut sheet media in a hardcopy device is the proper delivery of the media into the internal media feed path through which the media is driven. The media must be properly delivered from the media storage input device, such as a tray, so that the media is fed into the media drive mechanisms in the correct position and so that the media is oriented correctly relative to the media feed mechanisms.

As a convention for certain terms used herein, directional words such as "right" and "left", "above" and "below" are based on viewing the printer 10 from the position of the viewer in FIG. 1. Furthermore, the "X" axis is defined as the axis along which inkjet cartridges contained in housing 16 reciprocate. The "Y" axis is transverse to the X axis, and is the axis of media travel as the media is fed through a printzone, which in the case of an inkjet printer the area where ink is applied to the media. And the "Z" axis is the axis that extends vertically upward relative to the ground plane. These three axes are illustrated with an XYZ coordinate axis in FIG. 1.

Figure 1:
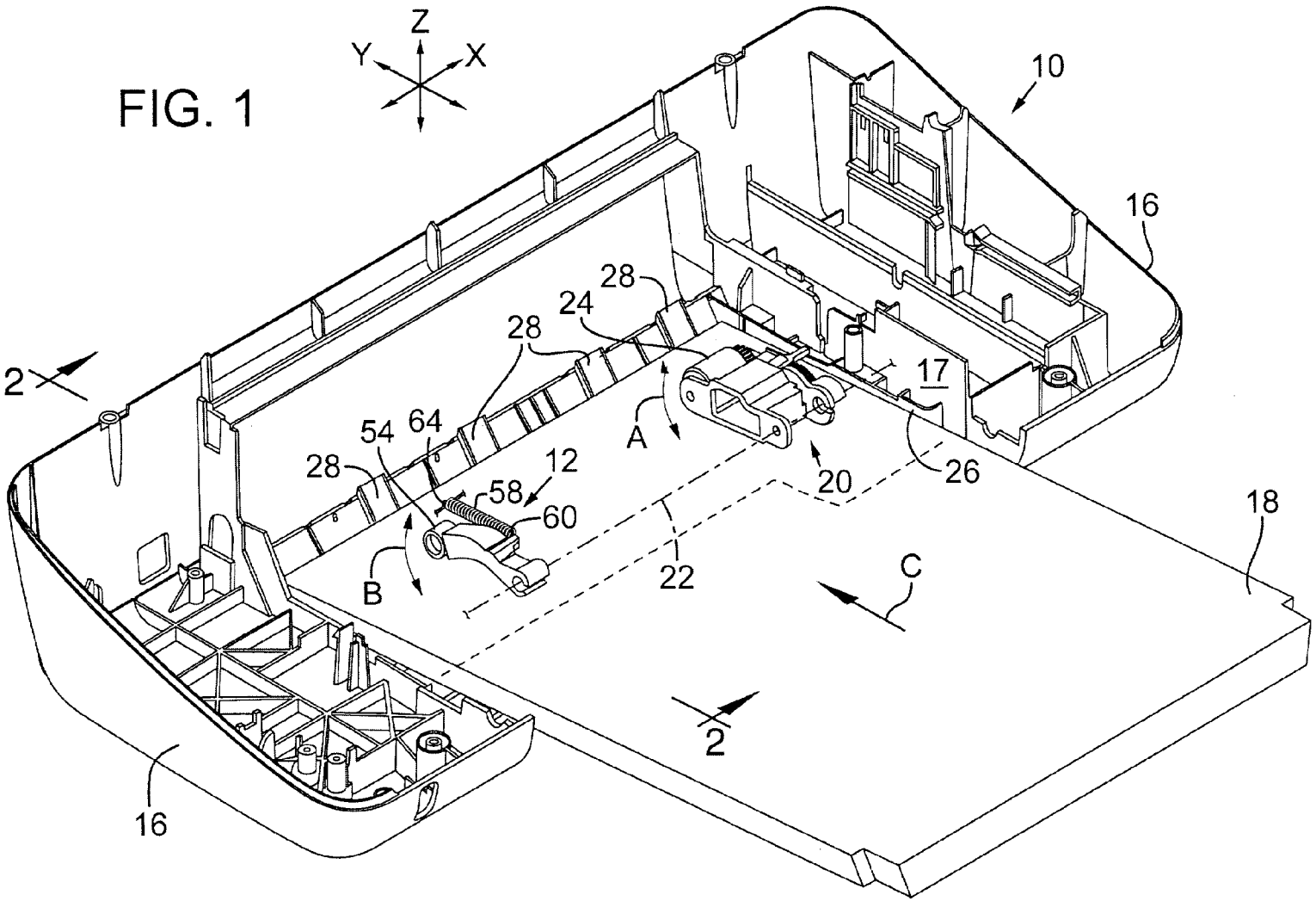
FIG. 1 is a semi-schematic perspective view of selected portions of a hardcopy device, here for the purposes of illustration shown as an inkjet printer illustrating a media bias assembly according to one illustrated embodiment the present invention housed in a printer chassis.

The semi-diagrammatic illustration of FIG. 1 shows pertinent portions of a hardcopy device, illustrated for purposes herein as a representative inkjet printer 10 in which an illustrated embodiment of a media bias assembly 12 according to the present invention is used. For purposes of clarity, many features of the printer structure and chassis are omitted from the figures. Although the invention is illustrated with respect to its embodiment in one specific type of printer, the invention may be embodied in numerous different types of hardcopy apparatus.

By way of background, most inkjet printers include a carriage that holds one or more ink-filled print cartridges. The carriage reciprocates in a back and forth motion across the printing surface along the X axis, positioning the ink cartridge or cartridges adjacent the recording media, such as paper, for printing. During the printing operation the carriage is shuttled across the paper and minute ink droplets are ejected out of the cartridge onto the paper in a controlled manner to form a swath of an image each time the carriage is scanned across the page. Between carriage scans, the paper is advanced along the Y axis with a media feed assembly so that the next swath of the image may be printed. Sometimes, more than one swath is printed before the paper is advanced.

The relative position of the print cartridge(s) and paper is precisely maintained to effect high-resolution, high-quality printing. The position of the print cartridge as it reciprocates in a back and forth motion across the media, and the positioning and control of paper advancement past the printhead are usually separately controlled, although their operation is coordinated with a printer controller.

Figure 2:
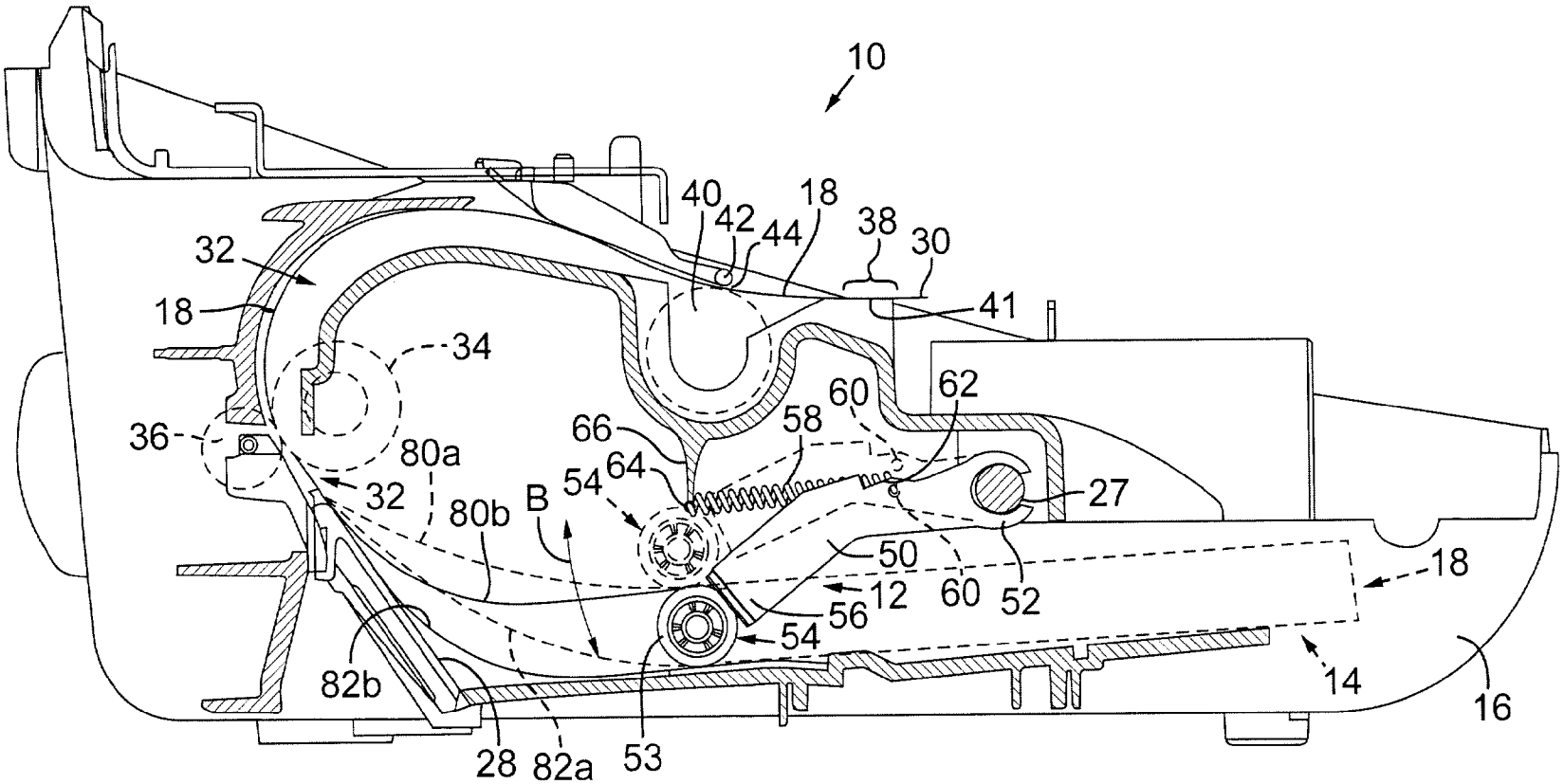
FIG. 2 is a cross sectional view taken generally along the line 2—2 of FIG. 1, and showing a semi-schematic view of the media bias assembly of FIG. 1, with portions of the chassis and associated structure not shown in FIG. 1.
Figure 3:
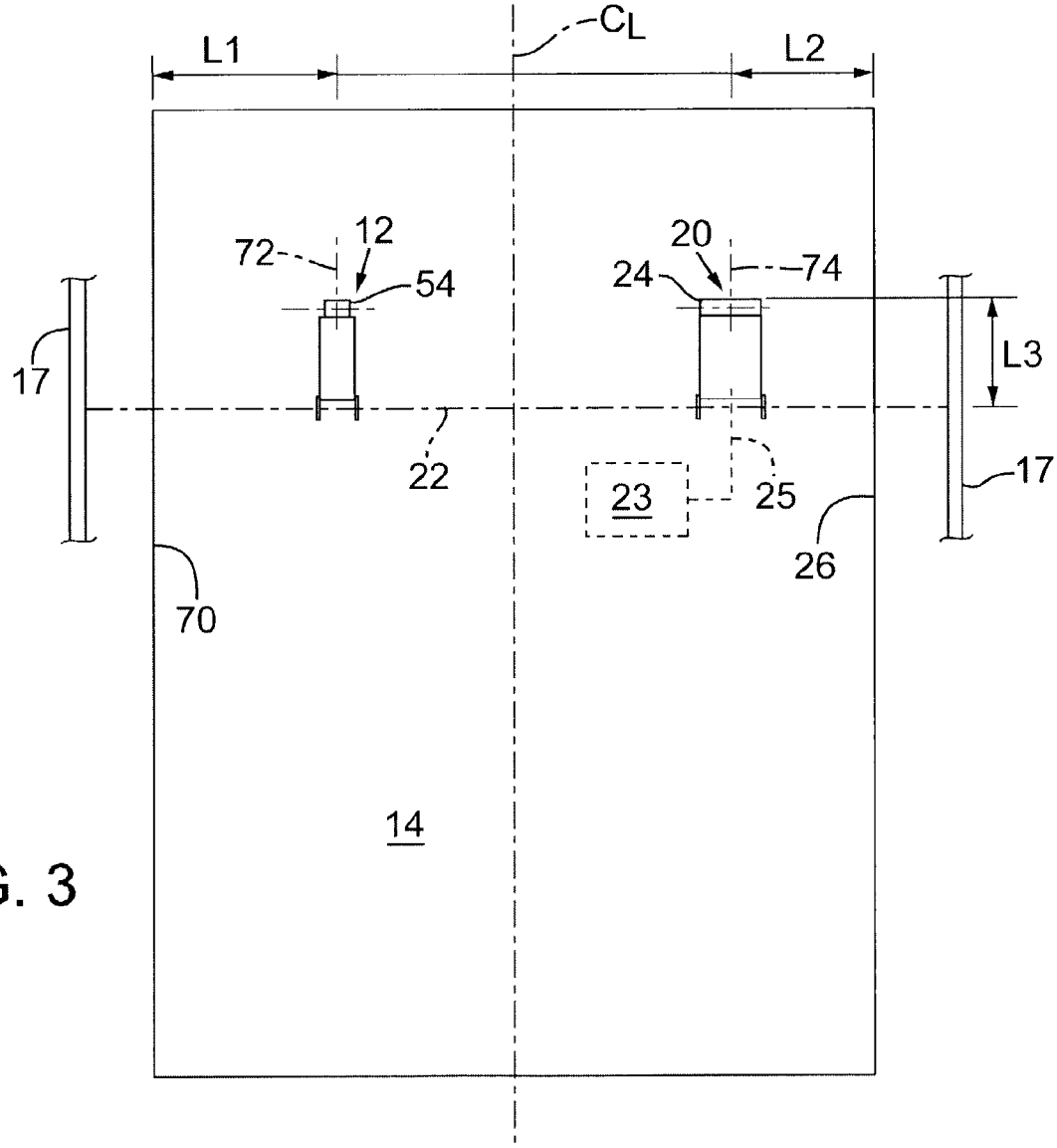
FIG. 3 is a schematic, top plan view of selected components of the illustrated media bias assembly showing the spatial orientation of the components.

Continuing with a general description of the inkjet printer 10, and with reference now to FIGS. 1 and 2, media 18 (such as individual cut sheet media which are represented schematically as a stack of media in FIG. 2) are held in input tray 14, ready for feeding into the media advancement assemblies in the printer. The media tray 14 is a passive tray—meaning that the tray is not spring-loaded. The media advancement assemblies include a pick arm assembly 20 that is pivotally mounted to a fixed chassis member that defines a pivot axis 22 that is parallel to the X axis. The fixed chassis member that serves as the mounting member for the pick arm assembly 20 may be, for example, mounts that are connected to the lower side of the platen 41 (FIG. 2). Pick assembly 20 includes a pick tire 24 that is a driven tire that is coated with rubber or other suitable friction-inducing compounds. The pick assembly 20 is biased downwardly with a suitable resilient mechanism such as a spring (not shown), along the Z axis as shown with arrow A so that the pick tire 24 is urged against media 18 held in input tray 14. Because the pick assembly 20 is biased downwardly and is mounted for pivotal rotation about pivot axis 22, the pick tire 24 remains in contact with the uppermost sheet of media 18 held in tray 14. As the number of individual sheets of media 18 in the tray decreases, pick tire 24 pivots downwardly to remain in constant contact with the uppermost sheet of media in the stack. A motor 23, shown schematically in FIG. 3, is operatively connected to pick assembly 20 through appropriate drive mechanisms 25 to drive pick tire 24. Motor 23 is mounted in any appropriate location in housing 16, and the motor may be utilized to operate other structures in the hardcopy device in addition to driving the pick tire.

Pick assembly 20 is mounted in a location toward the right edge 26 of tray 14. Printer 10 is designed to accommodate many different sizes of media, from standard 8½×11 and 8½×15 inch cut sheet paper, to envelopes, and others. Regardless of the size or type of media being used, the media is oriented in input tray 14 with one edge of the media abutting right edge 26 of tray 14. By locating the pick assembly 20 toward right edge 26, a single pick assembly 20 may be used to pick any sized media from the input tray.

As noted, pick tire 24 is driven by motor 23. In operation, pick tire 24 begins rotation to advance a single sheet of media into the media feed path through the printer. As media 18 is advanced from the input tray 14 by rotation of pick tire 24, the media leading edge 30 is first driven into a series of pick blocks 28 oriented laterally across the printer housing rearward of the input tray. The pick blocks 28 direct leading edge 30 upwardly, help to align the media 18, and guide the media 18 into media feed path 32 and toward the next media drive roller, turnroller 34. Turnroller 34 is, like pick tire 24, a friction-type drive wheel that cooperates with rear roller 36 to actively advance the media 18 through the media feed path 32, and through a printzone, shown generally at 38. A pinch is formed between turnroller 34 and rear roller 36 so that each sheet of media 18 is driven through media feed path 32. Just prior to the printzone 38 (i.e. "upstream" of the printzone) are a linefeed roller 40 and a pinch wheel 42. The interface between the linefeed roller 40 and pinch wheel 42 defines a linefeed pinch 44 that is parallel to the X axis. The printzone 38 is downstream of the linefeed pinch 44, is the area located immediately above platen 41, and is where ink is applied to the media 18.

As noted, many structural features in the printer are omitted from the drawings to clearly illustrate the invention. For example, printer 10 includes an inkjet cartridge(s) (not shown) and associated hardware mounted on a shaft for reciprocating movement along the X axis past the media and along an axis that extends transverse to the media feed axis, which is defined as the axis of media travel along the Y axis as the media is fed through the printzone 38. The inkjet cartridges are typically mounted to housing 16 or its chassis subcomponents by conventional means such as a carriage assembly. The particular housing 16 shown in the figures is used for illustration only, and is exemplary of the many different types of housing and subhousing assemblies that are used in printers of the type with which the present invention may be used.

The paper advance mechanisms must move the paper through the printzone the desired distance with each incremental advance, at the desired rate, and so that the paper is oriented correctly relative to the printheads. As noted above, there are several common printer problems that result from the failure to control these factors. These include linefeed errors and paper alignment errors. Overfeeding occurs when the linefeed roller incrementally advances the media too far relative to the printhead. On the other hand, underfeeding occurs when the paper has not advanced far enough. The result in either case is that ink is deposited in the wrong place on the paper, decreasing print quality. Skewing problems are caused by relative misalignment between the paper and the printheads. Ideally, the axis of media advancement should be perpendicular to the axis along which the printheads reciprocate. Stated in another way, the entire leading edge 30 of a sheet of media 18 should enter the linefeed pinch 44 at the same time rather than being angled with respect to it. When the paper advances through the printzone in any orientation other than the ideal, the paper is skewed and the quality of the print job decreases.

The printer microprocessor, also not shown, controls and synchronizes both the reciprocating movement of the carriage, and the linefeed so that ink is deposited in a desired manner on the media.

The structure and operation of media bias assembly 12 will now be described in detail. Media bias assembly 12 is pivotally mounted to a fixed chassis member that, in the illustrated embodiment, allows assembly 12 to pivot about pivot axis 22. The fixed chassis member that serves as the mounting member for the media bias assembly 12 may be, for example, be a shaft that is fixedly mounted to the lower side of the platen 41, such as shaft 27 shown in FIG. 2, which is coaxial with pivot axis 22. Shaft 27 allows the media bias assembly 12 to be pivotally rotated on the shaft about pivot axis 22. With reference to FIG. 2, assembly 12 includes an elongate bias arm 50 having a first end 52 pivotally mounted to shaft 27 and a bias wheel 54 rotatably mounted to the opposite end 56 of bias arm 50. A tensioning spring 58 has a first end 60 attached to bias arm 50 at a mounting boss 62 and a second, opposite end 64 attached to a fixed chassis arm 66. Tensioning spring 58 applies biasing force on bias arm 50 so that the arm is normally urged in the downward direction of arrow B in FIGS. 1 and 2. However, the tensioning spring 58 allows the bias arm to move upwardly against the spring force, in the upward direction of arrow B. This allows the bias arm 50 to adjust its position according to the amount of media 18 contained in input tray 14.

Bias arm 50 and the associated components are shown in two different positions in FIG. 2. In the first position, which correlates to an input tray that is filled with a stack of media 18, the bias arm 50 is shown in phantom lines. In the second position, which correlates to in input tray that is nearly empty, the bias arm 50 is shown in solid lines. As the number of sheets of media 18 decreases, bias wheel 54 which is mounted to end 56 of bias arm 50 moves downwardly through the action of tensioning spring 58, from the first position shown in FIG. 2 toward the second position, so the geometric orientation between the bias arm 50 and the media 18 changes in the same way that the geometric orientation between the pick tire 24 and media 18 changes as the height of media 18 in the stack of media decreases. At all times, bias wheel 54 is urged against the media 18 by the downward directed force applied by tensioning spring 58. It will also be appreciated that with respect to any single sheet of media 18, the force applied to the media is applied in a direction that is essentially normal to the plane defined by the upper surface of the media sheet.

FIG. 3 is a highly schematic view of selected components of printer 10 for the purposes of illustrating the spatial orientation and arrangement of these components. Specifically, both pick arm assembly 20 and media bias assembly 12 are illustrated as being pivotally mounted for rotation about pivot axis 22. The longitudinal centerline of input tray 14 is shown as line CL. Pick arm assembly 20 is mounted toward the right edge 26 of the input tray 14, and bias arm assembly 12 is mounted toward the left edge 70 of input tray 14. Bias arm assembly 12 is located on in a position such that the center point 72 of bias wheel 54 is spaced apart from left edge 70 by a distance represented by dimension L1. Media bias assembly 12 is mounted in a position such that the bias wheel 54 does not contact the edge of any standard cut sheet media, but instead contacts the media surface inwardly of the edge and without touching the edge of the media. Likewise, pick arm assembly 20 is located in a position such that the center point 74 of pick tire 24 is spaced apart from right edge 26 by a distance represented by dimension L2. In the illustrated embodiment, L1 is slightly greater than L2 to ensure that the bias wheel 54 contacts the surface of media held in the input tray 14 as opposed to the edge of the media. Furthermore, in the embodiment illustrated in FIG. 3 the distance from the pivot axis 22 to the axial center of pick tire 24 is represented by dimension L3. The distance from the pivot axis 22 to the axial center of bias wheel 24 is the same, L3. Accordingly, the distance from the pivot axis 22 to the point of contact between both bias wheel 54 and media 18, and pick tire 24 and media 18 is substantially the same.

The tensioning spring 58 is used to apply tension to bias arm 50, and the spring that applies tension to pick arm assembly 20 are selected so that the downwardly directed force applied to media 18 by bias wheel 54 on the one hand, and pick tire 24 on the other, are approximately equal. Because in all cases the media bias wheel 54 is not driven, the force exerted by the media bias wheel 54 on media 18 is passive.

The bias arm assembly 12 described herein cooperates with pick arm assembly 20 to advance media 18 into media feed path 20 such that the leading edge 30 of the media is properly oriented relative to the media feed mechanisms in the hardcopy device 10—that is, so that the media 18 is properly aligned as it enters the media feed path 32 such that the leading edge 30 is parallel to the linefeed pinch 44. At all times, bias arm assembly 12 applies force against the media 18. Likewise, pick arm assembly 20 applies a similar force against the media. Delivery and transport of media 18 from input tray 14 is initiated by the controller (not shown) beginning operation of pick arm assembly 20, and more specifically, by initiating rotation of driven pick tire 24. As pick tire 24 rotates, a single sheet of media 18 is advanced into the media feed path 32 in the direction indicated by arrow C in FIG. 1. At all times during which media 18 is advanced into media feed path 32 with pick tire 24, bias wheel 54, which as noted above is not driven and is urged against the media, freely rotates as the media passes under the wheel. The force applied against media 18 by bias arm assembly 12 causes the media to maintain a consistent curved shape across the width of the media (along the X axis) at all times. The media 18 is thus maintained in a symmetric configuration during delivery of the media into the media feed path 32. Stated another way, as pick tire 24 rotates it exerts force on media 18 in the direction of the Y axis. In the absence of media bias assembly 12 and bias wheel 54, the force exerted by rotation of pick tire 24 tends to cause the leading edge 30 of media 18 to be misaligned relative to the linefeed pinch 44. In other words, absent media bias assembly 12, the leading edge 30 near right edge of media 18 (at right edge 26 of input tray 14) tends to enter the pinch in media feed path at turn roll 34 after the leading edge 30 near the left edge. However, when a media bias assembly 12 is used the leading edge 30 of media 18 enters the pinch at turn roll 34 such that the leading edge is parallel to linefeed pinch 44.

With reference once again to FIG. 2, the symmetric, curved shape of media 18 achieved through use of bias arm assembly 12 is illustrated with two different media stack heights, and with two different types of media. In the first instance, input tray 14 is filled with media, and the paths of two different types of media that are being delivered into media feed path 32 are labeled with reference numbers **80*a* and 80*b*. The dashed line of path 80*a* represents the path that relatively stiff media 18 will follow as it is fed into the media feed path 32; the solid line of path 80*b* represents the path that relatively less stiff media 18 will follow. In the second instance, input tray 14 is nearly empty of media 18, and the paths of two different types of media that are being delivered into media feed path 32 are labeled with reference numbers 82*a* and 82*b*. The dashed line of path 82*a* represents the path that relatively stiff media 18 will follow; the solid line of path 82*b* represents the path that relatively less stiff media 18 will follow. In each case, regardless of the level of media 18 held in input tray 14 and regardless of the type of media used, the media maintains a consistent shape as it is fed into the media feed path. Stated another way, the leading edge 30 of media 18 is delivered from input tray 14 into media feed path 32 such that the leading edge is correctly positioned in the feed path, aligned so that the leading edge is parallel to the linefeed pinch 44**, which is in turn parallel to the X axis.

Having described the illustrated embodiment, it will be appreciated that numerous modifications may be made without departing from the scope of the claimed invention. As an example, the function of media bias assembly 12 may be accomplished with a bias arm 50 that has a curved surface that replaces media bias wheel 54 and which slides across media 18 as it is advanced into the media feed path 32. Although the friction between a curved surface and media 18 is inherently greater than with a freely rotating wheel such as bias wheel 54, the surface may be coated with friction-reducing coatings to sufficiently minimize the friction. As such, the outermost end of bias arm 50 that makes contact with media 18 should be considered a media shape inducing member, regardless of whether the member takes the form of a rotating bias wheel 54, a curved surface, or another shape. Also, pick arm assembly 20 and bias arm assembly 12 need not be mounted on a common shaft, and instead could be mounted on separate mounting structures such as bosses attached to, for example, platen 41. Similarly, there is no reason why the pick arm assembly 20 and bias arm assembly 12 need to be coaxially mounted such that they pivot about the same axis. Further, there are numerous equivalent structures that may be used to apply downwardly directed spring tension to both the bias arm assembly 12 and the pick arm assembly 20.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

The invention claimed is:

1. A media bias assembly for use in a hardcopy device having a driven pick roll for delivering media from a stack of media into the hardcopy device, comprising:

a media input tray having a longitudinal centerline;

a driven media pick roll mounted on one side of the centerline and configured for advancing media contained in the input tray to a media feed path;

a passive media bias arm having a media contacting surface on one end configured for making contact with media contained in the input tray, the arm spaced apart from the media pick roll on the opposite side of the centerline; and a spring configured to resiliently urge the media contacting surface towards media.

2. The media bias assembly according to claim 1 wherein the media contacting surface comprises a rotatable wheel.

3. The media bias assembly according to claim 1 wherein the spring has a first end connected to the media bias arm and an opposite end connected to a chassis member.

4. The media bias assembly according to claim 1 wherein the media bias arm and the media pick roll are spaced from the centerline by approximately the same distance.

5. The media bias assembly according to claim 1 wherein the media pick roll and the media bias arm are pivotally mounted so that they pivot about the same pivot axis.

6. The media bias assembly according to claim 5 wherein the media pick roll and the media bias arm each define a media contacting surface and wherein the distance from the pivot axis to the media contacting surface on the media pick roll is the same as the distance from the pivot axis to the media contacting surface on the media bias arm.

7. The media bias assembly according to claim 6 wherein the media pick roll and the media bias arm are separately mounted to chassis members.

8. The media bias assembly according to claim 1 wherein the media pick roll further defines a media pick roll media contacting surface and including means for resiliently urging said media contacting surface toward media contained in the input tray.

9. The media bias assembly according to claim 8 wherein both the media pick roll media contacting surface and the media bias arm contacting surface are urged toward media contained in the input tray with substantially the same amount of force.

10. The media bias assembly according to claim 9 wherein the media defines a media plane, the media bias arm contacting surface contacts the media and exerts force thereon, and the force is exerted in a direction substantially transverse to the media plane.

11. A method of aligning a sheet of media taken from a media source as the sheet is advanced into a media feed path in a hardcopy device, the method comprising the steps of:

(a) urging a total number of pick rolls into contact with a sheet of media contained in a media source so that the pick rolls collectively contacts the sheet at one or more positions laterally eccentric with respect to a longitudinal centerline extending along the media source;

(b) rotating the pick rolls to advance a leading edge of the sheet into a media feed path;

(c) exerting passive pressure on the sheet at one or more positions laterally offset from the longitudinal centerline while the sheet is being advanced into the media feed path.

12. The method of claim 11 wherein step (c) further comprises exerting passive pressure on the sheet with a freely rotating wheel mounted on an elongate arm.

13. The method of claim 11 wherein the media source contains plural individual sheets of media and the method includes the step of sequentially feeding individual sheets into the media feed path and wherein passive pressure is exerted on each sheet.

14. The method of claim 13 wherein each sheet of media defines a leading edge, and including the step of maintaining the shape of each sheet of media fed into the media feed path so that the leading edge of each sheet is fed into the media feed path in the same orientation.

15. Apparatus for advancing media from a media source into a media feed path in a hardcopy device, comprising:

a media input tray configured for containing plural individual sheets of media in a stack, the media input tray defining a longitudinal centerline;

a media pick apparatus mounted on a first side of the centerline and having a pick roll configured for contacting a sheet of media in the media tray and advancing the sheet to a media feed path;

a motor connected to the media pick apparatus for rotating the pick roll;

passive media bias means mounted on the second side of the centerline and defining a contact surface for applying pressure to a sheet of media in the tray, wherein the passive media bias means further comprises means for resiliently urging the contacting surface toward media contained in the input tray.

16. The media input apparatus according to claim 15 wherein the contacting surface of the passive media bias means further comprises a freely rotatable and non-driven wheel.

17. The media input assembly according to claim 15 wherein the means for resiliently urging comprises a spring having a first end connected to the passive media bias means and an opposite end connected to a chassis member.

18. A hardcopy device, comprising:

a supply source of media contained in an input tray;

a media delivery mechanism comprising:

a driven media pick wheel positioned off-center relative to a centerline through the media supply source;

a non-driven media contact member positioned off-center relative to and on the opposite side of the centerline from the pick wheel;

a resilient member for urging the non-driven media contact member into contact with media contained in the input tray.

19. The hardcopy device of claim 18 wherein the media contact member further comprises a wheel rotatably mounted on an elongate arm.

20. An apparatus comprising:

a media input tray having a longitudinal centerline;

a total number of pick rolls configured to contact a sheet of media contained in the media input tray, wherein the total number of pick rolls are configured to collectively contact a sheet of media in the media input tray at positions laterally eccentric with respect to the longitudinal centerline; and at least one passive media bias arm configured to engage the sheet in the media input tray at one or more positions laterally offset from the longitudinal centerline.

21. The apparatus of claim 20, wherein the total number of pick rolls includes a first pick roll on a first side of the longitudinal centerline laterally spaced from the longitudinal centerline by a distance and wherein the total number of pick rolls omits a second pick roll on a second side of the longitudinal centerline that is laterally spaced from the longitudinal centerline by the same distance.

22. A media bias assembly for use in a hardcopy device having a driven pick roll for delivering media from a stack of media into the hardcopy device, comprising:

a media input tray having a longitudinal centerline;

a driven media pick roll mounted on one side of the centerline and configured for advancing media contained in the input tray to a media feed path; and a passive media bias arm having a media contacting surface comprising a rotatable wheel on one end configured for making contact with media contained in the input tray, the arm spaced apart from the media pick roll on the opposite side of the centerline.

23. A media bias assembly for use in a hardcopy device having a driven pick roll for delivering media from a stack of media into the hardcopy device, comprising:

a media input tray having a longitudinal centerline;

a driven media pick roll mounted on one side of the centerline and configured for advancing media contained in the input tray to a media feed path; and a passive media bias arm having a media contacting surface on one end configured for making contact with media contained in the input tray, the arm spaced apart from the media pick roll on the opposite side of the centerline, wherein the media bias arm and the media pick roll are spaced from the centerline by approximately the same distance.

24. A media bias assembly for use in a hardcopy device having a driven pick roll for delivering media from a stack of media into the hardcopy device, comprising:

a media input tray having a longitudinal centerline;

a driven media pick roll mounted on one side of the centerline and configured for advancing media contained in the input tray to a media feed path; and a passive media bias arm having a media contacting surface on one end configured for making contact with media contained in the input tray, the arm spaced apart from the media pick roll on the opposite side of the centerline, wherein the media pick roll and the media bias arm are pivotally mounted so that they pivot about the same pivot axis.

* * * * *

UNITED STATES PATENT AND TRADEMARK OFFICE

CERTIFICATE OF CORRECTION

PATENT NO. : 7,004,460 B2
APPLICATION NO. : 10/423368
DATED : February 28, 2006
INVENTOR(S) : Tom Ruhe et al.

It is certified that error appears in the above-identified patent and that said Letters Patent is hereby corrected as shown below:

In column 8, line 24, in Claim 11, delete "contacts" and insert -- contact --, therefor.

Signed and Sealed this

Sixth Day of October, 2009

David J. Kappos

David J. Kappos
*Director of the United States Patent and Trademark Office*